United States Patent [19]

Nutter

[11] Patent Number: 4,919,039

[45] Date of Patent: Apr. 24, 1990

[54] HYDRAULIC TURNING GEAR

[75] Inventor: Norman E. Nutter, Lunenburg, Mass.

[73] Assignee: General Electric Company, Schenectady, N.Y.

[21] Appl. No.: 223,850

[22] Filed: Jul. 25, 1988

[51] Int. Cl.[5] ..... F15B 21/02

[52] U.S. Cl. ..... 91/40; 91/304; 91/321; 91/330; 91/417 R; 91/461; 74/578

[58] Field of Search ..... 74/160, 128, 578; 91/417 R, 461, 304, 39, 40, 321, 330; 417/225, 226, 227

[56] References Cited

U.S. PATENT DOCUMENTS

| | | | |
|---|---|---|---|
| 2,238,317 | 4/1941 | Gensburg | 74/160 |
| 2,592,940 | 4/1952 | Monoyer | 417/225 X |
| 2,803,110 | 8/1957 | Chittenden | 91/304 X |
| 2,947,187 | 8/1960 | Graff et al. | 74/160 X |
| 2,970,546 | 2/1961 | White | 417/225 |
| 3,791,230 | 2/1974 | Webb | 74/128 |
| 4,018,094 | 4/1977 | Schmidt | 74/128 |
| 4,768,420 | 9/1988 | Korthaus | 91/417 R |
| 4,811,651 | 3/1989 | Hata et al. | 74/128 X |

*Primary Examiner*—Edward K. Look

*Attorney, Agent, or Firm*—Nixon & Vanderhye

[57] ABSTRACT

A turning gear is used to rotate a turbine rotor under conditions where it is heating up or cooling down without sufficient motive fluid to cause it to rotate. The turning gear avoid the occurence of a thermal bow. A hydraulic turning gear is disclosed for application in confined areas where a substantial force is required to provide rotation to the rotor. A booster cylinder is used to elevate low pressure fluid for use in a reduced diameter hydraulic cylinder. A ratchet wheel and pawl mechanism uses an adjustable friction force to withhold the pawl from the ratchet wheel after initial contact and further employs a stationary guide rail to reset the pawl for the next contact.

14 Claims, 3 Drawing Sheets

HYDRAULIC TURNING GEAR

This invention was made in the course of Government Contract No. N00024-83-C-4181 (Prime) and N3352-766 (Subcontract) for the United States Navy and rights to the invention are determined by the provisions in those contracts.

BACKGROUND OF THE INVENTION

This invention relates, in general, to rotating turbomachines and to turning gears for rotating a turbine rotor when motive fluid is insufficient to cause the rotation of the turbine rotor. In particular, this invention further relates to a hydraulic system and associated turning gear which is reduced in size for shipboard applications and which utilizes low pressure hydraulic fluid in combination with pressure boost means to provide sufficient turning power despite the reduced size of the equipment.

Rotating machinery such as turbines, including steam turbines or gas turbines, require means associated with the rotating machinery to turn the turbine rotor whenever the motive fluid, steam or gas, is insufficient to cause the rotor to turn but while the rotor is at an elevated temperature such as during periods of warm-up, cool-down or if the supply of motive fluid is shutdown for some reason. The reason for utilizing a turning gear on a heated rotor is that if the rotor is not turned under these conditions it will develop or bow or sag as thermal conditions change which could result in the turbomachine being rendered inoperative.

One way of rotating a turning gear in through the use of an electric motor which is coupled to the rotor. However, in this arrangement, the motor must be located adjacent the turbine rotor and as the power requirements for rotating the turbomachine rotor increase the size of the motor must also increase such that it has been found difficult to meet the envelope requirements of the turbine environment. Also, with the increase in size of the motor there is also an increase in weight which is an undesirable characteristic in modern ship power plants. Another compromising feature of electric motors used as turning gear drivers occurs under complete loss of power conditions where the turbomachine rotor could be severely endangered if rotation is not effected.

Another means for rotating a turbomachinery rotor is through the use of a hydraulic turning gear wherein hydraulic fluid is used to drive a hydraulic cylinder which, in turn, drives a ratchet and pawl mechanism for turning the turnbomachine rotor. This type of apparatus is generally smaller, lighter weight, able to function by means of a handpump or manual valve control for emergency operation and less expensive. However, as power requirements for rotating the turning gear have increased, the size of the hydraulic equipment has also been caused to increase. For example, one main piece of equipment in the hydraulic turning gear system which must be placed in the vicinity of the turning gear is the hydraulic cylinder. Using low pressure oil (100 psi) as the driving fluid would result in a ten inch diameter hydraulic cylinder in a very crowded space near the turbine equipment. The low pressure hydraulic fluid is preferred since it is also used for lubrication fluid therefore allowing the use of a single fluid supply. In one aspect of this invention it has been found that the size of the hydraulic cylinder may be reduced to a two inch diameter hydraulic cylinder if the pressure of the hydraulic fluid to the driving side of the hydraulic cylinder is raised after it has been withdrawn from a common reservoir. The reservoir is remotely located with respect to the hydraulic cylinder and therefore does not add to the size requirements of the turbine equipment envelope and by reducing the size of the hydraulic cylinder makes the turning gear apparatus more fittable into the turbine environment.

A booster cylinder provides a desirable means for raising the pressure of the hydraulic fluid prior to the introduction of the fluid into the hydraulic cylinder of reduced size.

The hydraulic cylinder motivates a ratchet and pawl mechanism for turning the turning gear wheel. Realizing that this means that the pawl which engages the ratchet wheel must pivot to engage and disengage from the ratchet wheel several times in each shaft revolution, the disadvantage of a spring return for the pawl is the noise it may create as it hits after each tooth. According to another feature of the present invention, the pawl of the present invention utilizes frictional force to withhold the pawl from the ratchet wheel and then uses a positively driven reset to realign the pawl with the ratchet wheel thus obviating the use of a noise producing spring.

It is therefore an object of the present invention to provide a hydraulic turning gear which provides an elevated pressure fluid to a hydraulic cylinder of reduced size for driving the turning gear.

It is another object of the present invention to provide a means for raising the hydraulic fluid pressure at a location inline and removed from the fluid reservoir.

It is another object of the present invention to provide a pawl mechanism which will produce a quiet return of the pawl to the ratchet wheel.

The novel features believed characteristic of the present invention are set forth in the appended claims. The invention itself, however, together with further objects and advantages thereof may best be understood with reference to the following description and drawings.

SUMMARY OF THE INVENTION

In accordance with the present invention, a hydraulic turning gear comprises a ratchet wheel attached to a turbomachine rotor and a pawl mechanism for driving the ratchet wheel and turbomachine rotor. The pawl mechanism is attached to the reciprocating arm of a hydraulic cylinder which is driven by a high pressure fluid. In a preferred embodiment, the high pressure fluid is supplied from an inline booster pump. The stroke of the hydraulic cylinder is controlled by a spool valve the position of which is set by a timer driven solenoid. The pawl mechanism is improved by a construction which provides a frictional force to withhold the pawl itself from the ratchet wheel as it disengages at the top of the hydraulic cylinder stroke and then allows the pawl to be reset or realigned by means of a guide rail contacted at the bottom of the hydraulic cylinder stroke.

DETAILED DESCRIPTION OF THE INVENTION

Figure 1:
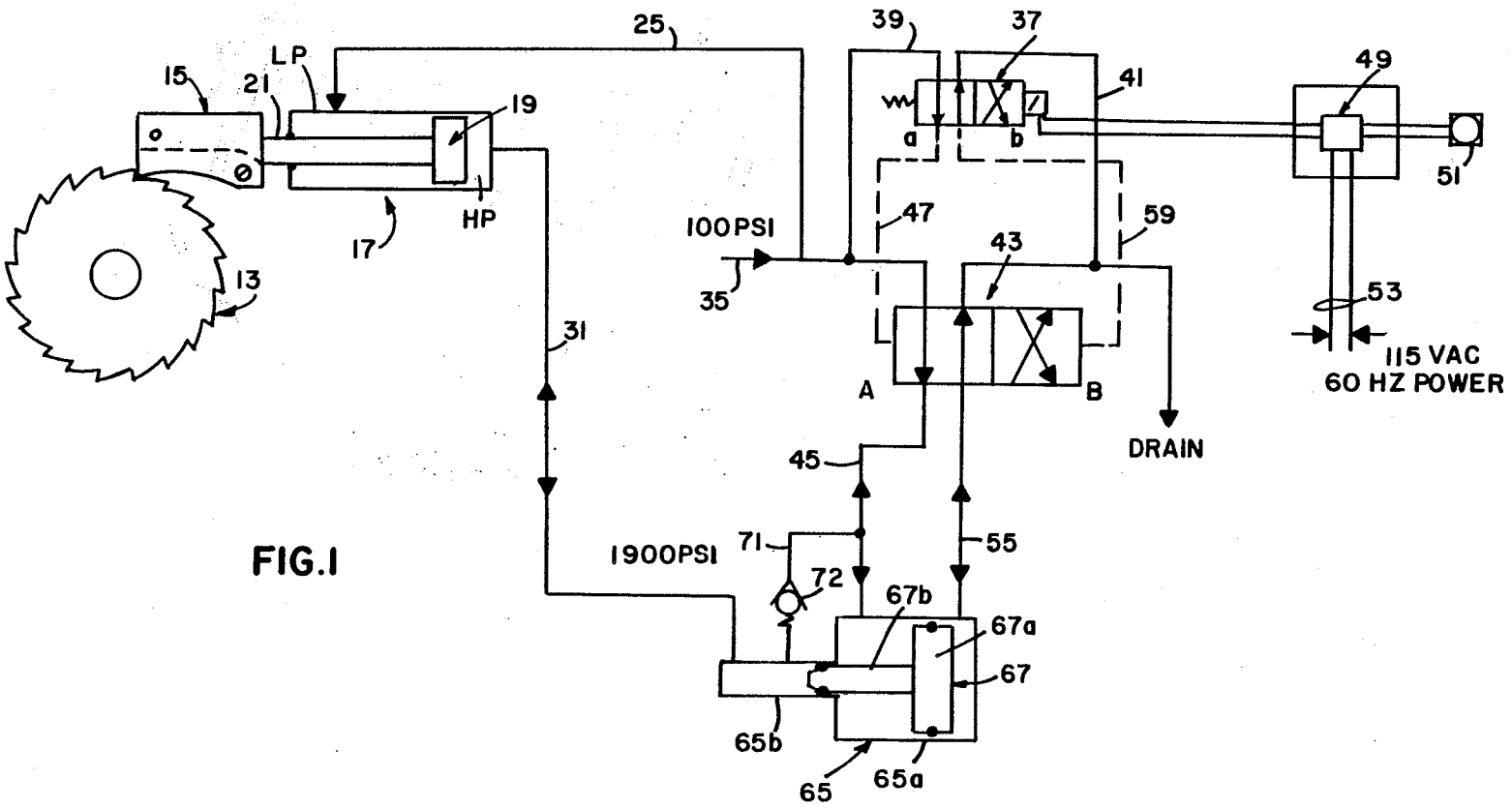
FIG. 1 is a schematic drawing of a hydraulic turning gear.

FIG. 1 is a schematic diagram of a hydraulic turning gear which includes a ratchet wheel 13 which may be attached to one end of a turbine rotor (not shown). The ratchet wheel may be fitted to a stub shaft of a turbine by means of shrink fitting or by mechanical means. In accordance with the present invention, the turbine could be a steam turbine which is part of a ship's service turbine/generator power plant which supplies electricity aboard a ship. Alternatively, there is nothing about the present invention which would preclude its use on a propulsion set or other type of power plant including a gas turbine power plant. A pawl mechanism 15 drives the ratchet wheel 13. The pawl mechanism is driven in a reciprocal movement by a hydraulic cylinder 17 to which it it attached. The reciprocal movement of the pawl mechanism imparts rotational movement to the ratchet wheel and the turbine rotor shaft to which it is attached. The hydraulic cylinder may include a piston 19 which has a piston rod or extended arm 21 which extends through one end of the hydraulic cylinder which is closest to the pawl mechanism 15. The piston rod or arm 21 itself is connected to the pawl mechanism in a manner yet to be described. The hydraulic cylinder 17 is connected at its high pressure side (HP) to high pressure fluid line 31 which drives the piston 19 toward the ratchet wheel 13 which causes it to rotate. The hydraulic cylinder 17 is connected at its low pressure side (LP) to a low pressure fluid line 25 which drives piston 19 away from the ratchet wheel during disengagement. Since the fluid in line 25 acts only against the piston 19 when the high pressure side is draining, the fluid in line 25 may be low pressure fluid. Alternatively, a coil spring may be used to drive the piston away from the ratchet.

Relatively low pressure oil, at about 100 psi, is supplied as indicated on line 35. The low pressure oil is obtained from a common oil reservoir which may also contain control oil. The oil is admitted to a two position, four-way pilot or solenoid valve 37 through inlet line 39 and expelled to drain through a discharge line 41. The position of the solenoid valve 37 controls the flow of fluid to a directional spool valve 43. As shown in FIG. 1, fluid on line 39 is passed through the "a" side of solenoid valve 37 which causes it to position spool valve 39 in its corresponding position "A". This is caused by the flow of fluid in control line 47 as indicated by the dashed line. This allows low pressure fluid from line 35 to be passed through spool valve 43 into line 45. It also allows fluid within line 55 to be connected to drain.

Solenoid valve 37 is connected to a timer 49 which may be actuated by a start switch 51 and powered from an electrical source 53. The timer will cause the solenoid to cycle from position "a" to position "b" as required by the rotor conditions and programmed into the timer. When the timer causes the solenoid to switch from parallel internal fluid lines, position "a" to crossed internal fluid lines, position "b", then control fluid in line 47 is connected to drain and control fluid in line 59 is connected to the low pressure fluid supply. This causes spool valve 43 to be shifted to position "B" which then connects line 55 to low pressure fluid line 35 and line 45 to drain. Lines 45 and 55 are connected to a hydraulic booster cylinder 65.

The hydraulic booster cylinder includes a piston 67 which is caused to reciprocate by the admission and draining of fluid from the booster cylinder. The booster cylinder includes a large diameter cylinder **65*a* and a small diameter cylinder 65*b* whereas the piston 67 includes a large diameter piston head 67*a* which drives a piston rod or ram 67*b* which extends into the small diameter cylinder 65*b*. It will be observed that fluid in line 71 is also input through spring loaded check valve 72 into smaller cylinder 65*b* ahead of the ram 67*b*. Fluid is also admitted into the booster cylinder behind the piston head 67 through line 55. The operation of the booster cylinder is readily apparent from its construction as shown in FIG. 1. Fluid in line 45 is used to push the piston to the right while it also is filling the small diameter cylinder 65*b* through line 71 and check valve 72. This assumes that spool valve 43 is in poisition "A" with parallel internal fluid lines so that fluid is input into line 45 whereas line 55 is connected to drain. In the second part of the stroke, spool valve 43 is in its "B" connection having crossed fluid lines whereby line 55 is connected to the fluid supply and line 45 is connected to drain. In this step, the fluid in the small diameter cylinder 65*b* is pressurized to about 1900 psi from about 100 psi and it charges line 31. The increased pressure in line 41 causes the piston 19 in hydraulic cylinder 17 to move left against the force of oil pressure from line 25 causing the pawl mechanism 15 to rotate the ratchet wheel 13 in a counterclockwise direction. When spool valve is again in position "A", fluid is once again admitted in front of piston head 67*a* and into small diameter cylinder 65*b* whereas the force of oil pressure from line 25 in cylinder 17 causes the piston 19 to move to the right, thereby moving the pawl mechanism away from the ratchet wheel 13**. In accordance with the invention the hydraulic boost cylinder allows the use of hydraulic fluid at relatively low oil pressure such as is used for hydraulic control functions to be used to drive the turning gear without enlarging the hydraulic cylinder located in the area ratchet whell and the turbomachine. The invention further saves weight which might be attributable to a larger hydraulic cylinder and a separate oil tank to hold turning gear oil. Finally, the hydraulic boost cylinder may be placed wherever it is convenient rather than being required adjacent the turbine rotor.

Figure 2:
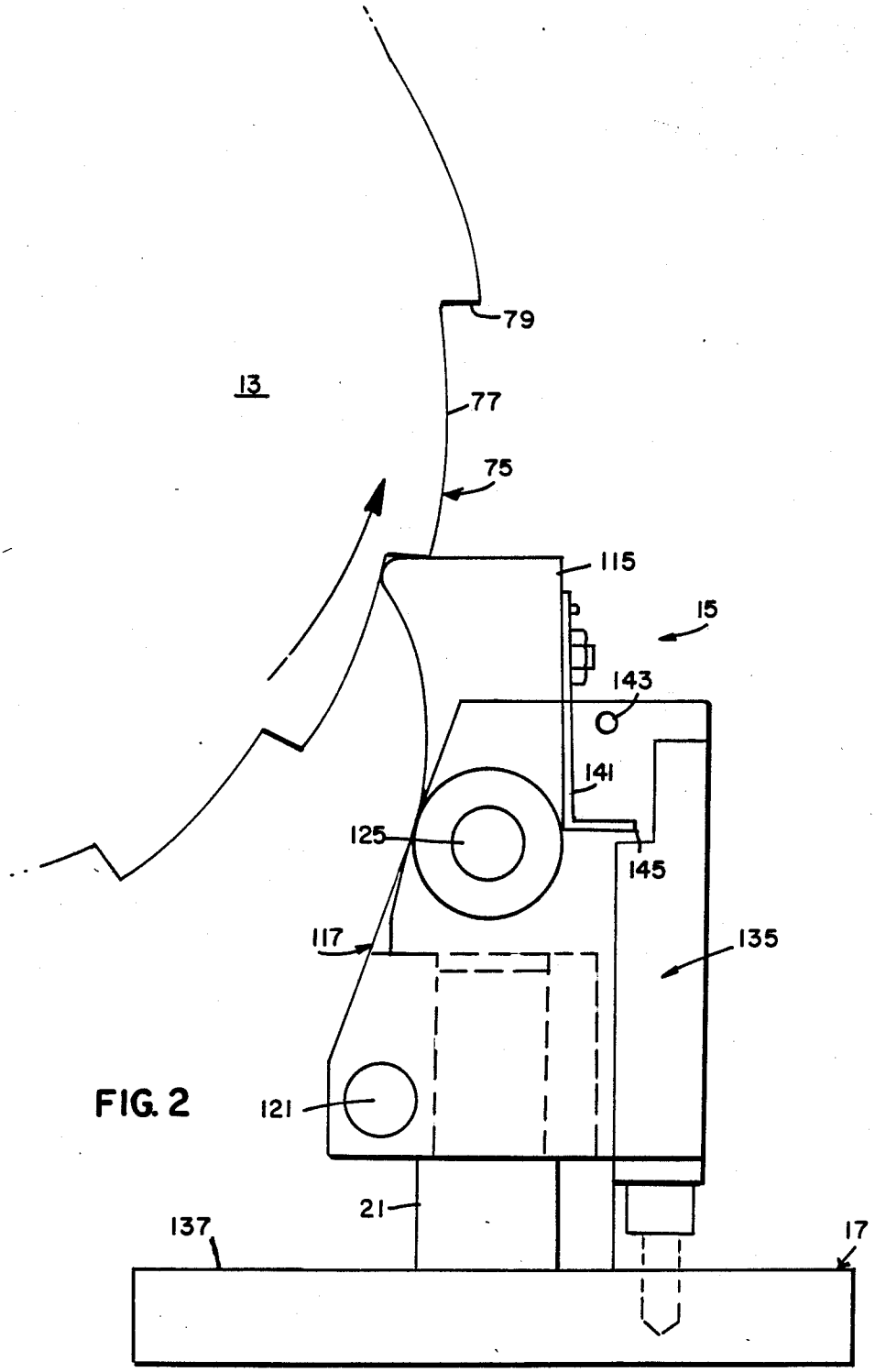
FIG. 2 is a side elevation view of the ratchet wheel and pawl mechanism.
Figure 3:
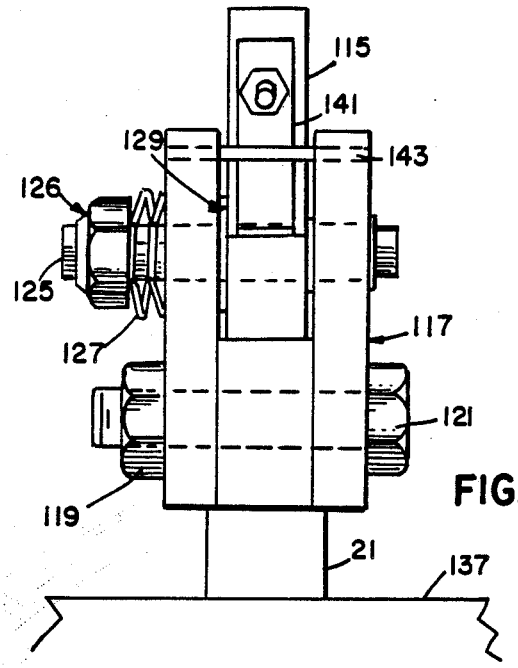
FIG. 3 is an end view of the pawl mechanism.
Figure 4:
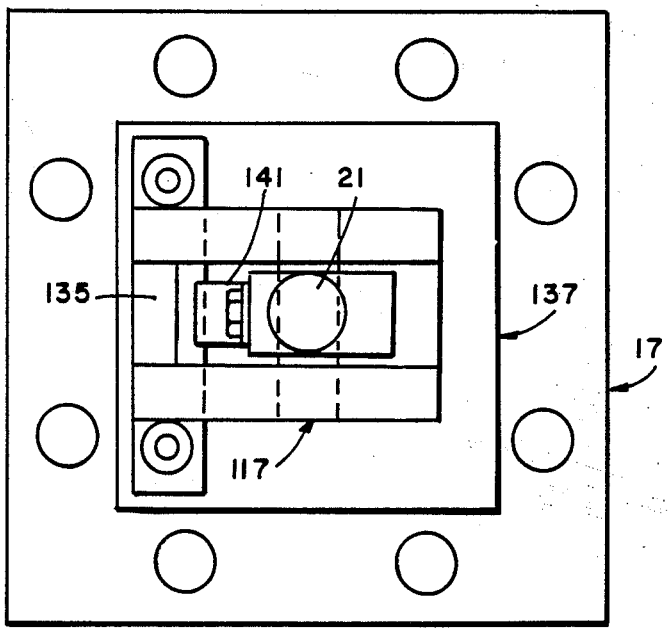
FIG. 4 is a plan view of the pawl mechanism.

Referring now to FIGS. 2,3 and 4, which respectively show side and end elevation views and a plan view of the pawl mechanism 15 in accordance with the present invention. The ratchet wheel 13 includes a plurality of circumferentially mounted ratchet teeth 75 which generally include a step portion 77 and a riser portion 79. The pawl mechanism 15 pushes against the riser portion of the of a ratchet tooth and pushes the wheel in a counterclockwise direction. The pawl mechanism 15 includes a pawl 115 and a sawcut clevis 117. The clevis is mounted on the extended arm or piston rod 21 of the hydraulic cylinder which is driven by the piston 19 in the hydraulic cylinder. A nut 119 and bolt 121 removably fasten the clevis to the hydraulic cylinder arm.

The pawl 115 is mounted to the clevis 117 so that it will pivot around the pin 125. Stacked Belleville washers 127 provide and adjustable force applied to the clevis which in conjunction with the friction washer 129 provides a frictional forcr on the pawl 115 which prevents it from rotating back, on its own, toward the ratchet wheel once it is pushed away from the ratchet wheel by teeth 75. Locking nut 126 retains the Belleville washers on the pin 125. Thus as the pawl pushes the ratchet wheel counterclockwise, the step portion 77 will push the pawl away from the ratchet wheel and it will remain in that position due to the friction washer and Belleville washer until contact is made with guide rail 135. Guide rail 135 is mounted to a cylinder mount plate 137 which is part of the hydraulic cylinder 17. The clevis is guided by the guide rail 135 as it reciprocates toward and away from the ratchet wheel. An "L" shaped tang 141 is mounted on the pawl 115 and as the pawl is rotated, by the ratchet wheel away from the wheel, it will contact a stop pin 143. However, as the pawl mechanism is further withdrawn away from the ratchet wheel the tange on the pawl will contact the guide rail 135 at land 145 to cause the pawl to become realigned for the next stroke of the hydraulic cylinder. In accordance with the present invention, the heretofore spring return used in the practice of a ratchet and pawl turning gear mechanism is now replaced by the positive resetting brought about by the guide rail and tang which resets the pawl for engagement with ratchet wheel.

The operation of the invention is as follows. A hydraulic turning gear includes a ratchet wheel 13 and a pawl mechanism 15 for rotating a turbine rotor (not shown). The pawl mechanism is caused to move in a reciprocating manner by a hydraulic cylinder 17 which is alternately filled and then drained. The hydraulic cylinder is reduced in size because of the high pressure hydraulic fluid which is received from a boost hydraulic cylinder 65. The boost hydraulic cylinder is also caused to cycle in a reciprocating manner due to a spool valve 43 which inputs relatively low pressure hydraulic fluid into the booster cylinder. The spool valve has two positions which are set by a solenoid valve 37 responding to a timer 49. The invention allows the utilization of low pressure fluid to drive higher power turning gears without a penalty in weight or larger envelope requirements.

Still with further consideration to the invention, the pawl mechanism 15 is developed for use with the hydraulic turning gear just described and includes a Belleville spring 127 and friction washer 129 for retaining the pawl 115 itself within the clevis 117 so that once the pawl is pushed away from the ratchet wheel it will remain withdrawn until it can be reset by means of guide rail 135 which bears against tang 141 as the pawl mechanism reaches the furthest point away from the ratchet wheel before recycling back toward the ratchet wheel. In this way, the pawl is positively reset rather than depending on a return spring.

While there has been shown what is considered to be a preferred embodiment of the present invention other modification may occur to those of ordinary skill in the art. It is intended to cover all such modifications as fall within the true spirit and scope of the appended claims.

What is claimed is:

1. A hydraulic turning gear for imparting rotational movement to a rotor comprising:

a ratchet wheel for attachment to the rotor;

a pawl mechanism for engaging the ratchet wheel;

a hydraulic cylinder connected to the pawl mechanism causing the pawl mechanism to reciprocate whereby the linear movement of the pawl mechanism causes the ratchet wheel to rotate;

a source of relatively low pressure hydraulic fluid for driving the hydraulic cylinder;

a booster cylinder for raising the pressure of the relatively low pressure fluid to a higher pressure sufficient to drive the hydraulic cylinder; the booster cylinder being connected to the hydraulic cylinder; and, valve means for directing the relatively low pressure hydraulic fluid to drive the booster cylinder, and wherein the hydraulic cylinder includes an arm which extends externally from the hydraulic cylinder and the pawl mechanism includes a clevis which is mounted to the hydraulic cylinder arm and a pawl which is pivotally attached to the clevis, and further wherein the pawl is pivotally attached to the clevis by means of a pin extending through both the pawl and the clevis, and further including means on said pin for imparting an adjustable frictional force between the pawl and the clevis whereby the pawl, once pivoted, needs a reset force to return to its original position for engaging the ratchet wheel.

2. The hydraulic turning gear recited in claim 1 wherein the means for imparting a frictional force between the pawl and the clevis includes a plurality of stacked Belleville washers.

3. The hydraulic turning gear recited in claim 1 further including stop means to limit the extent of pivot of the pawl.

4. The hydraulic turning gear recited in claim 1 wherein the booster cylinder includes a small diameter cylinder and a large diameter cylinder and a piston head slidably mounted in the large diameter cylinder and hydraulic fluid may be admitted on either side of the piston head to drive the piston head in a reciprocating movement; and, a ram attached to and following the movement of the piston head, the ram mounted, in part, in the small diameter cylinder and fluid admitted into the small diameter cylinder being pressurized by the ram.

5. The hydraulic turning gear recited in claim 4 wherein the valve means includes a spool valve connected between the low pressure fluid and the booster cylinder, the spool valve having alternate positions for admitting fluid to one side or the other of the piston head in the booster cylinder.

6. The hydraulic turning gear recited in claim 5 further comprising a pilot valve for positioning the spool valve, the pilot valve connected to the low pressure fluid source.

7. The hydraulic turning gear recited in claim 6 wherein the pilot valve is a solenoid valve and wherein the turning gear further includes a timer and electrical supply connected to the solenoid valve whereby the spool valve, booster cylinder, hydraulic cylinder and pawl mechanism is caused to move in preset timed manner.

8. A hydraulic turning gear for imparting rotational movement to a rotor comprising:

a ratchet wheel for attachment to the rotor;

a pawl mechanism for engaging the ratchet wheel;

a hydraulic cylinder connected to the pawl mechanism causing the pawl mechanism to reciprocate whereby the linear movement of the pawl mechanism causes the ratchet wheel to rotate;

a source of relatively low pressure hydraulic fluid for driving the hydraulic cylinder;

a booster cylinder for raising the pressure of the relatively low pressure fluid to a higher pressure sufficient to drive the hydraulic cylinder; the booster cylinder being connected to the hydraulic cylinder; and, valve means for directing the relatively low pressure hydraulic fluid to drive the booster cylinder, and wherein the hydraulic cylinder includes an arm which extends externally from the hydraulic cylinder and the pawl mechanism includes a clevis which is mounted to the hydraulic cylinder arm and a pawl which is pivotally attached to the clevis, and said hydraulic gear further comprising:

a pin attaching the pawl pivotally to the clevis;

a plurality of stacked Belleville washers for provding a variable frictional force between the pawl and the clevis;

a stationary guide rail for guiding the linear path of the pawl mechanism including the clevis; the guide rail also contacting the pawl to move it from a pivoted positon to a reset position.

9. The hydraulic turning gear recited in claim 8 wherein there is a tang attached to the pawl which contacts the guide rail when the pawl mechanism is furthest withdrawn from the ratchet wheel.

10. A hydraulic turning gear form imparting rotational movement to a rotor comprising:

a ratchet wheel for attachment to a rotor;

a pawl mechanism including a pawl element movable between ratchet wheel aligned and ratchet wheel disengagement positions;

hydraulic means including a piston rod for linearly moving said pawl mechanism toward and away from said ratchet wheel, said pawl element operatively connected by pin means to one end of said piston rod for pivotal movement relative to said piston rod, said pawl element being operable to engage and rotate said ratchet wheel upon extension of said piston rod with the pawl element in the ratchet wheel aligned position; and adjustable friction means mounted on said pin means for holding said pawl element in said ratchet wheel disengagement position.

11. A hydraulic turning gear as defined in claim 10 wherein said ratchet wheel includes surface means for moving said pawl element from said ratchet wheel aligned position to said ratchet wheel disengagement position upon extension of said piston rod and rotation of said ratchet wheel.

12. A hydraulic turning gear as defined in claim 10 and further including stationary guide means for moving said pawl element to said ratchet wheel disengagement position upon retraction of said piston rod.

13. A hydraulic turning gear comprising:

a ratchet wheel for attachment to a turbine rotor;

a pawl mechanism for selectively engaging the ratchet wheel, the pawl mechanism operating in a linear reciprocating manner;

a hydraulic cylinder attached to the pawl mechanism;

a hydraulic booster cylinder fluidly connected to the hydraulic cylinder for supplying high pressure fluid to the hydraulic cylinder;

a spool valve having two operating positions for supplying low pressure fluid to the hydraulic booster cylinder whereby the hydraulic booster cylinder moves in a reciprocating manner; and, a pilot valve for positioning the spool valve, the pilot valve and the spool valve being connected to a source of low pressure hydraulic fluid.

14. A hydraulic turning gear comprising:

a ratchet wheel attachable to a rotor;

a hydraulic cylinder having a piston mounted within the hydrualic cylinder and a piston rod extending outside the hydraulic cylinder;

a pawl mechanism including a pawl and clevis mounted to the piston rod; the pawl being pivotally mounted to the clevis with an adjustable friction force therebetween;

a guide rail mounted to the hydraulic cylinder and the clevis being slidable with respect to the guide rail whereby the pivotal pawl is pivoted away from the ratchet wheel after initial contact therewith and is reset by the guide rail.

* * * * *